United States Patent [19]

March

[11] 4,374,555

[45] Feb. 22, 1983

[54] CARRYING CASE WITH GUARDS

[75] Inventor: Joseph E. March, Chicago, Ill.

[73] Assignee: Platt Luggage, Inc., Chicago, Ill.

[21] Appl. No.: 228,672

[22] Filed: Jan. 26, 1981

[51] Int. Cl.[3] ..... A45C 13/04; A45C 13/36

[52] U.S. Cl. ..... 190/48; 190/49

[58] Field of Search ..... 190/48, 49, 50, 53, 190/54, 41 R; 150/1.6

[56] References Cited

U.S. PATENT DOCUMENTS

| | | | |
|---|---|---|---|
| 437,366 | 9/1890 | Peterson . | |
| 1,636,060 | 7/1927 | Kennedy . | |
| 1,658,997 | 2/1928 | Mulford . | |
| 1,710,582 | 4/1929 | Lifton . | |
| 1,975,294 | 10/1934 | Sand et al. | 190/41 |
| 2,389,601 | 11/1945 | DeWitt | 229/23 |
| 2,420,150 | 5/1947 | Riess | 190/48 |
| 2,669,273 | 2/1954 | Keirsey | 150/1.6 |
| 2,985,266 | 5/1961 | Pelavin | 190/43 |
| 3,023,867 | 3/1962 | Kotkins | 190/41 |
| 3,084,771 | 4/1963 | Davis | 190/41 |
| 3,169,615 | 2/1965 | Stein | 190/48 |
| 3,198,299 | 8/1965 | Axtell et al. | 190/49 X |
| 3,259,217 | 7/1966 | Platt | 190/48 |
| 3,330,388 | 7/1967 | Stein | 190/48 |
| 3,938,630 | 2/1976 | March | 190/54 X |

FOREIGN PATENT DOCUMENTS

| | | | |
|---|---|---|---|
| 2758392 | 7/1979 | Fed. Rep. of Germany | 190/53 |
| 24841 | 5/1921 | France . | |
| 10292 | of 1891 | United Kingdom . | |
| 198 | of 1904 | United Kingdom . | |
| 142251 | 5/1920 | United Kingdom | 190/54 |
| 881139 | 11/1957 | United Kingdom . | |

*Primary Examiner*—William Price
*Assistant Examiner*—Sue A. Weaver
*Attorney, Agent, or Firm*—Fitch, Even, Tabin, Flannery & Welsh

[57] ABSTRACT

The present invention relates to a carrying case, and more particularly to a carrying case adaptable for carrying relatively heavy items. Guards of rigid material disposed on end shells of the case cooperate synergistically with rivet assemblies to provide exceptional strength, rigidity, durability and damage resistance to the carrying case.

1 Claim, 6 Drawing Figures

Fig. 4.
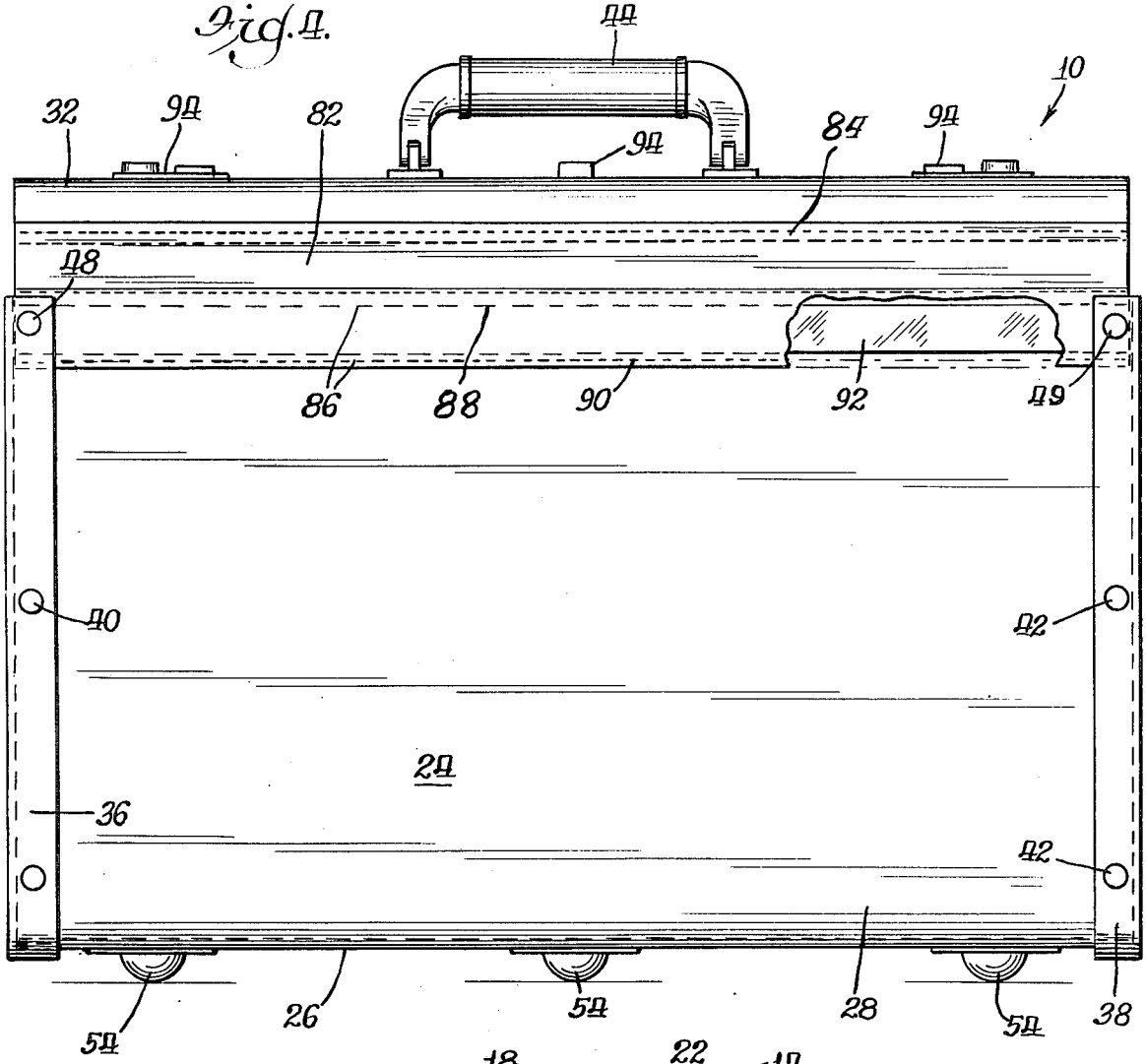
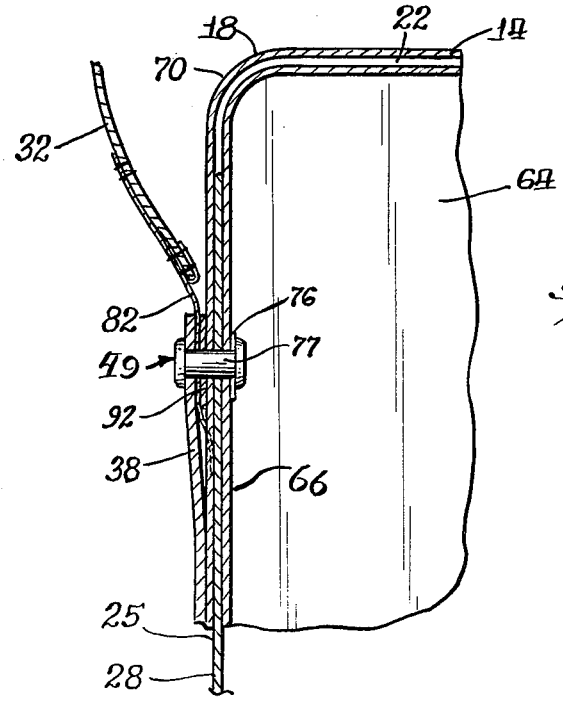
Fig. 5.

94
44
82
94
94
92
34
80
25
30
36
12
62
16
20
24
52
60
56
26
25
32
28
46
90
54
14
77
76
49
22
18
72
74
68
70
49
66
60
58
92
82
38

CARRYING CASE WITH GUARDS

BACKGROUND OF THE INVENTION

The present invention relates generally to an article of hand luggage and in particular concerns a more durable carrying case.

Generally those forms of luggage which are adapted to be carried by hand must be relatively light in weight so as to avoid adding unnecessary weight to the load being carried. At the same time the article must have a relatively rigid structure so that it is adaptable for carrying relatively heavy loads, such as catalogs, samples, etc., without being twisted or deformed.

Platt, U.S. Pat. No. 3,259,217, discloses such a product which has proven to be a commercial success. In Platt, a unitary member constitutes the bottom and side walls of a carrying case; the unitary member is secured by stitches within channels defined by peripheral flanges of rigid, generally rectangular end shells. Lid flaps are pivotally stitched to the unitary member so that the case may be opened and closed. The Platt case is attractive in appearance and durable in use. Its end shell plus unitary wall construction provides a rigid structure with significant structural strength and load-bearing properties.

However, there remains a need for a carrying case which can withstand more exceptional levels of use and abuse while preserving the positive qualities of the Platt case. More specifically, a case is needed which can withstand tendencies for structural deformation and wear induced by extraordinary carrying loads. Additionally, it is necessary that a case resist being scuffed or otherwise damaged by rough handling.

SUMMARY OF THE INVENTION

In accordance with the present invention, U-shaped guards cooperate synergistically with rivet assemblies to provide a more rigid, durable, and damage resistant carrying case. The U-shaped guards of metal or other durable material are affixed to peripheral flanges of a carrying case which thereby acquires increased structural rigidity and structural strength at points of maximum stress. Additionally, the guards serve to protect the most vulnerable portions of the carrying case. The rivet assemblies, which secure the guards to the flanges, also serve to secure walls within the channels of the end shells. The guards anchor the rivet assemblies so that the latter will not tear away under high load-bearing conditions or other hard use.

A general object of this invention is to provide an improved carrying case which preserves the positive qualities of the Platt case while displaying increased structural strength, rigidity, and durability.

A more specific object of this invention is to provide an improved carrying case of the Platt type exhibiting greater structural rigidity which will better resist the distorting forces induced by exceptionally heavy carrying loads.

Another object of this invention is to provide an improved carrying case of the Platt type better able to resist fatigue and wear.

It is also an object of this invention to provide a more durable means securing the major components of a carrying case.

A further object of this invention is to provide an improved carrying case of the Platt type which is more resistant to scuffing and other damage.

Other objects and advantages of the invention will become apparent with reference to the following description and the accompanying drawings.

BRIEF DESCRIPTION OF THE DRAWINGS

FIG. 4 is a front elevational view of the carrying case of FIG. 1.

FIG. 5 is a sectional view taken along line 5—5 of FIG. 1.

DESCRIPTION OF THE PREFERRED EMBODIMENT

Figure 1:
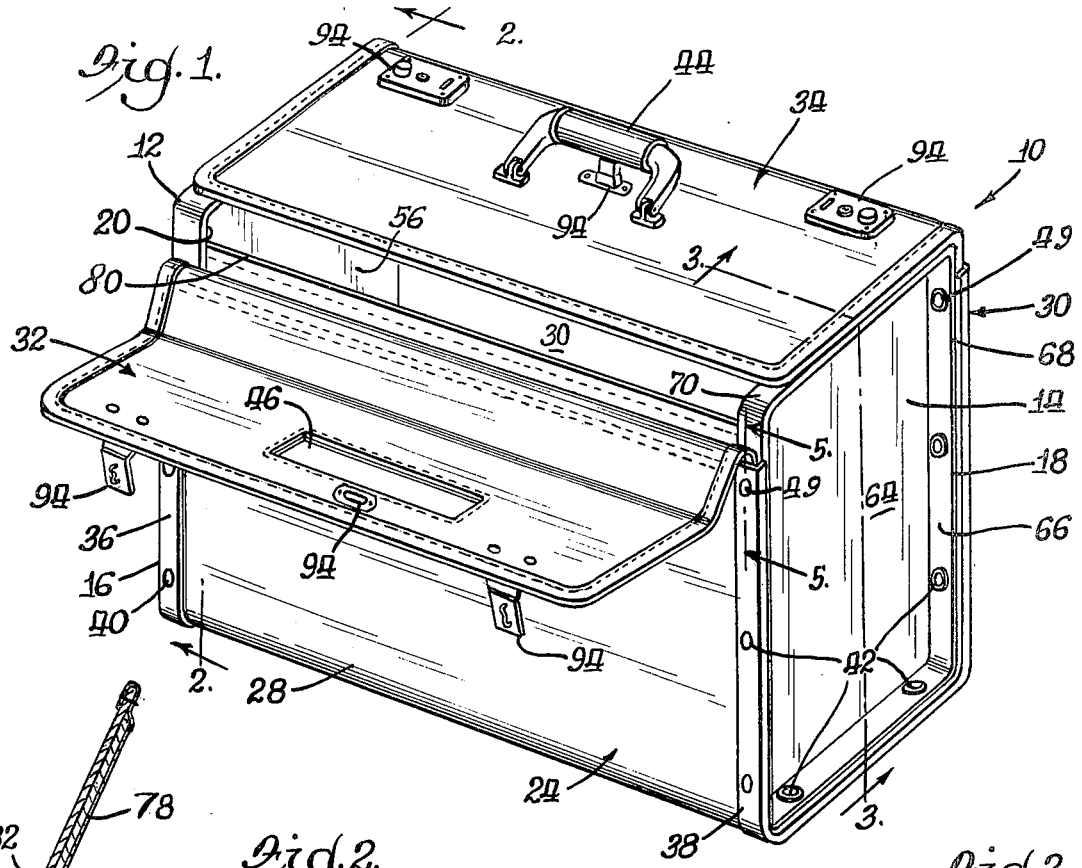
FIG. 1 is a perspective view of a carrying case embodying the present invention.

Referring to the drawings, a carrying case, shown generally at 10 in accordance with the present invention, includes a pair of end shells 12 and 14 with peripheral flanges 16 and 18 defining inwardly facing channels 20 and 22. A unitary member 24 comprising a bottom wall 26, and side walls 28 and 30, is received within corresponding portions of the channels 20 and 22. Overlying lid flap 32 and underlying lid flap 34 are pivotally mounted along the top of the side walls 28 and 30 so that the carrying case may be opened and closed. For expository purposes, the side wall adjacent to the overlaying lid flap is referred to as the "front side wall" 28, and the side wall adjacent to the underlying lid flap is referred to as the "rear side wall" 30. U-shaped guards 36 and 38 with L-shaped cross sections are disposed about the portions of the peripheral flanges 16 and 18 corresponding to the unitary member 24. Plural series of rivet assemblies 40 and 42 secure the guards to the flanges and secure the walls within channels 20 and 22. The underlying lid flap 34 is provided with a suitable handle 44 which is received through a corresponding aperture 46 in the front overlying lid flap 32 when the carrying case is closed so that the case may be conveniently carried.

In accordance with the present invention, the U-shaped guards 36 and 38 cooperate synergistically with associated series of rivet assemblies 40 and 42 to provide increased structural rigidity, durability and damage resistance to the carrying case 10. The rivet assemblies secure the guards to the peripheral flanges 16 and 18 of the end shells. The guards, which consist of a strong, hard and rigid material such as steel, enhance the structural integrity of the carrying case as a whole. Since the guards protrude beyond the softer and more vulnerable walls 26,28, and 30, flaps 32 and 34, and end shells 12 and 14 they afford protection from blows and abrasion. The guards serve to anchor the rivet assemblies so that the latter will not tear away even under continued extreme use and abuse. The guards further cooperate with upper rivet assemblies 48 and 49 to provide additional strength to the junctions 50 of the flaps, walls and end shells, these junctions being points of maximum load-bearing stress.

Figure 2:
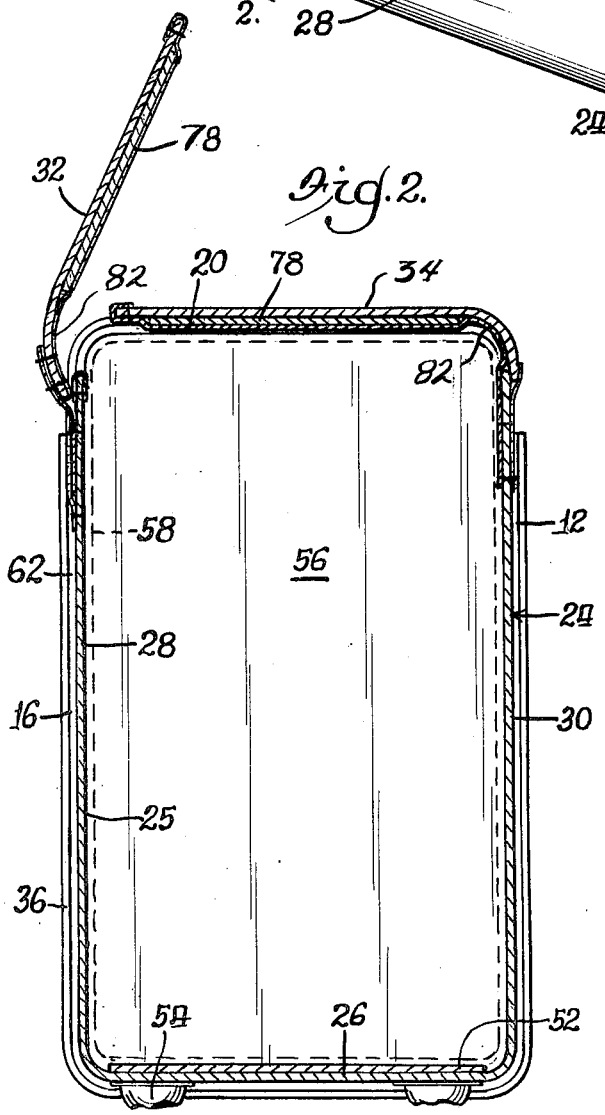
FIG. 2 is a sectional view taken along line 2—2 of FIG. 1.
Figure 3:
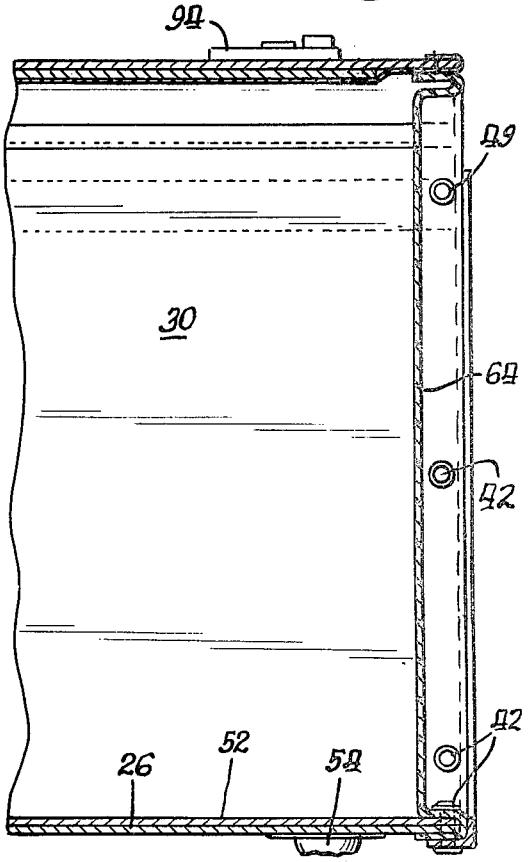
FIG. 3 is a sectional view taken along line 3—3 of FIG. 1.

Referring now in greater detail to the drawings, the unitary member 24 is generally U-shaped in cross section and is formed of a single sheet of material so as to form a durable integral structure. As shown in FIGS. 2 and 3, the bottom wall 26 of the unitary member is provided with structural reinforcement by disposing a reinforcing bottom plate 52 on the inner surface of the bottom wall in overlying relationship and generally coextensive therewith. The plate 52 is preferably secured to the bottom wall by gluing and is in turn overlaid by a thin layer of leather or leatherette material (not shown) so as to retain an attractive appearance. Since the bottom wall 26 carries a substantial amount of stress when a load is carried in the case 10, and is generally subjected to relatively hard usage, the plate 52 is further secured to the bottom wall 26 by the provision of a plurality of rivets (not shown).

The bottom wall 26 is generally provided with suitable feet 54 which project downwardly from the lower surface thereof and serve to support the case when it is in a vertically upright position as shown in FIG. 1. Preferably, the feet 54 are secured to the bottom wall 26 by rivets (not shown) so that the plate 52, the bottom wall 26, and the feet 54 constitute a rigid structure.

The bottom wall 26, front side wall 28, and rear side wall 30 which, as previously mentioned, constitute unitary member 24, are preferably fabricated of a relatively durable material which is attractive in appearance, such as a laminated leatherette. The walls forming the unitary member 24 define an open-ended, open-topped structure, the ends of which are closed by the end shells 12 and 14.

Figure 6:
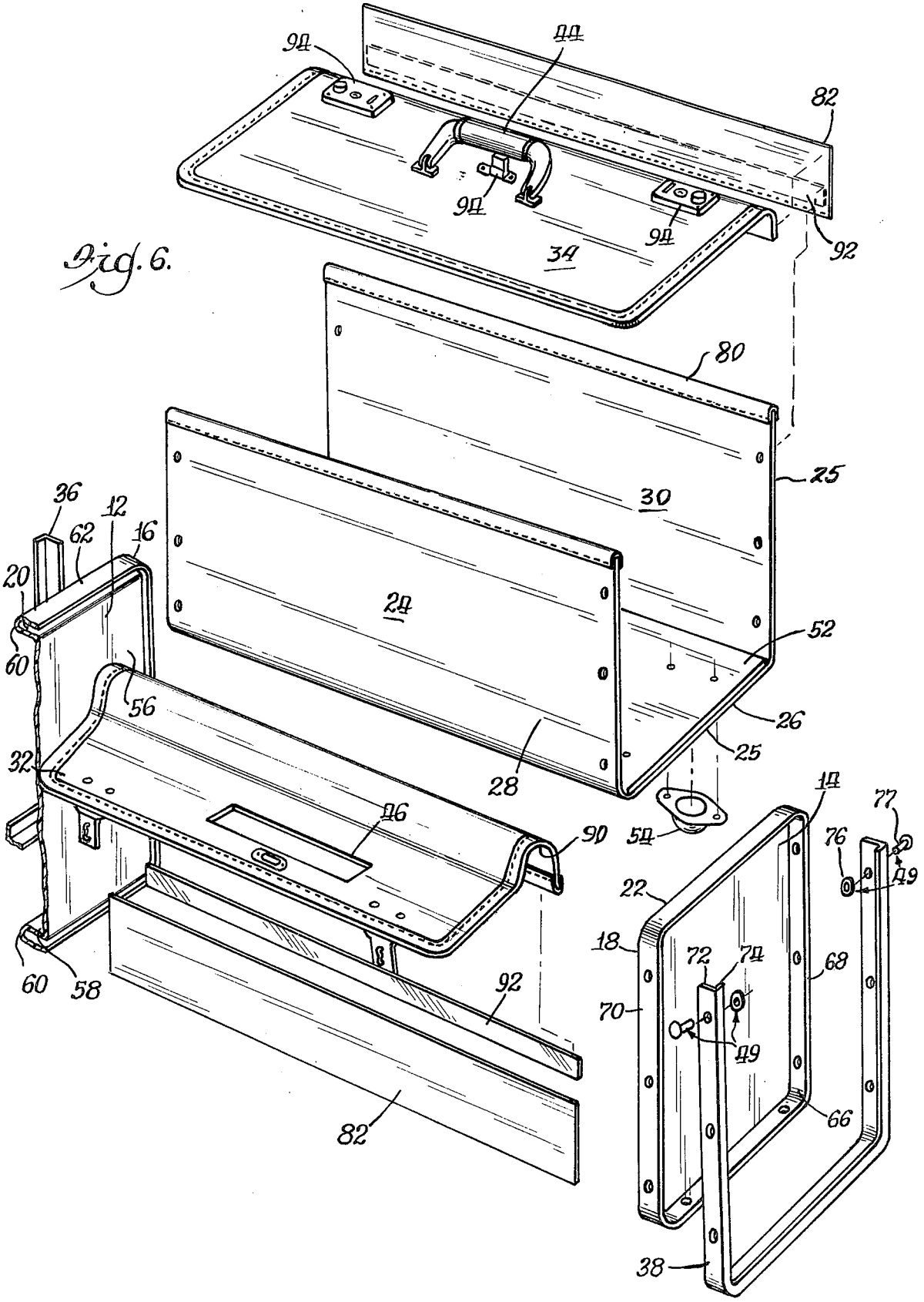
FIG. 6 is an exploded view of the carrying case of FIG. 1.

Describing each end shell in greater detail with particular reference to FIG. 6, end shell 12 consists of rigid plastic and comprises a textured, roughly rectangular flat panel 56 with arcuate corners and a flange 16 extending substantially along the periphery of the panel so that the shell 12 is roughly rectangular with arcuate corners. The flange 16 includes a lesser periphery 58 which extends outwardly and substantially orthogonally to the panel, a curved portion 60 whereby the flange is reversed upon itself, and a greater periphery 62 extending inwardly and substantially parallel to the lesser periphery. The lesser periphery, curved portion, and greater periphery sequentially constitute the flange and define an inwardly facing channel 20. Placed in opposition to shell 12 is end shell 14 of like material and form comprising panel 64, flange 18, lesser periphery 66, curved portion 68, and greater periphery 70; flange 18 defines channel 22.

The U-shaped guard 36 is disposed about flange 16 of the end shell 12 along the portion corresponding to the walls of the unitary member 24. More particularly, guard 36 is provided with an L-shaped cross section so that the longer arm 72 of the "L" extends upon the surface of the greater periphery opposite channel 20 and the shorter arm of the "L" 74 extends along the surface of the curved portion 60 opposite channel 20. Guard 36 consists of metal or other rigid durable material and serves generally to structurally strengthen the carrying case 10. More specifically, the guard 36 reinforces flange 16 so as to prevent potential bowing or warping of panel 56; additionally, the guards protect the outer surface of panel 56 from being defaced, scuffed or otherwise damaged when subjected to exceptional use or abuse. Furthermore, the guards provide for more durable attachment of the unitary member 24 to end shell 12, as is subsequently described in detail. Guard 38 is similar to guard 36 in shape and material, and serves an analogous function in reinforcing and protecting end shell 14. The guards also provide an attractive and trim end appearance.

The end shells 12 and 14 are attached to the unitary member 24 by disposing the side edges 25 of the member 24 into the opposed aligned channels 20 and 22. A series of rivet assemblies 40 secures guard 36 to end shell 12 and secures an edge of unitary member 24 within channel 20. Each of the series of rivet assemblies 40 extends through sequentially the lesser periphery 58, the unitary member 24, the greater periphery 62, and the guard 36, thereby securing the unitary member to end shell 12 and the guard 36 to the flange 16. Each of the series of rivet assemblies 42 extends through sequentially the lesser periphery 66, the unitary member 24, the greater periphery 70, and the guard 38, thereby securing the unitary member to end shell 14 and the guard 38 to flange 18. The guards 36 and 38 serve as a secure anchor which will not tear away from the heads of the rivet assemblies 40 and 42 so that the combination of guards and rivet assemblies assures the durable securing of the unitary member to the end shells. Each of the rivet assemblies includes a washer 76 which serves as a counter-anchor reinforcing the securement of the rivet 77 to the lesser periphery of the flanges. During assembly, the rivet is inserted through the washer and, immediately thereafter, a second rivet head is formed securing the rivet to the washer.

The lid flaps 32 and 34 have flat and bowed portions so as to conform to the end shells 12 and 14 when the former are in a closed position. The flat portion of each lid flap includes a reinforcing flap plate 78 and overlying inner and outer layers of material (not shown) such as leather, leatherette, vinyl, etc.

It is quite advantageous to attach the lid flaps 32 and 34 to the side walls 28 and 30 at a point spaced below the upper ends of the latter. Such a configuration provides increased access to the interior of the carrying case, since there is no interference by the lid flaps, while yielding increased protection for the contents when the lid flaps are in an open position. Since the side walls 28 and 30 together with the end shells 12 and 14 extend above the pivot point at which the lid flaps 32 and 34 are attached, increased protection is afforded any contents of the case when the lid flaps 32 and 34 are in an open position by virtue of the upwardly extending portions, which in effect form a peripheral ledge 80. Since the lid flaps are similar in structure and are attached in similar manners, only the front attachment assembly structure will be detailed.

Referring now to FIG. 4, a flexible hinge 82 extending from end shell to end shell is secured to the overlying lid flap 32 by means of a double row of stitches 84. A portion of the hinge extends beyond the flap and is secured to the front side wall 28 by means of spaced parallel rows of stitching 86, including an upper row 88 and a lower row 90.

To further increase the rigidity of this attachment, an elongated reinforcing strip 92 of a material such as steel or other metal is disposed between the parallel rows of stitching 88 and 90 intermediate the hinge 82 and the front side wall 28. The strip 92 is longitudinally coextensive with the hinge 82 and is secured at its opposite ends to the hinge 82 and the front side wall by rivet assemblies 48 and 49 which are also the topmost rivet assemblies of series 40 and 42 securing the front side wall 28 to flange 16 and to flange 18. As shown in FIG. 5, rivet assembly 49 extends through lesser periphery 66, side edge 25 of unitary member 24, greater periphery 70, reinforcing strip 92, hinge 82, and guard 38. Similarly, rivet assembly 48 extends through lesser periphery 58, edge 25 of unitary member 24, greater periphery 62, reinforcing strip 92, hinge 82, and guard 36. Guards 36 and 38 provide additional support and rigidity to reinforcing strip 92. Thus, an extremely strong bond is provided between the lid flap 32 and the front side wall 28. Moreover, it can readily be seen that by virtue of its particular design, when the case is in a loaded state and is being carried by the handle 44, most of the stress is concentrated on the rivet assemblies securing the lid flaps 32 and 34 to the guards and flanges. Thus, the greater stress is generally concentrated at the particular portions of the article which are provided with the greatest structural strength.

The lid flap 34 is secured to the hinge 82 by the double row stitching 84 along a line spaced from the upper stitching 88 so as to allow the lid flap to pivot about the region intermediate the stitching 84 and the lower stitching 90. The lid flap is bowed at its end at which it is attached to the hinge 82 a sufficient amount to permit it to snugly fit around the arcuate corners of the end shells 12 and 14 and rest on the upper flanged portions thereof, when the lid flap is in a closed position. Then, as previously mentioned, the contents are protected, even when the lid flaps 32 and 34 are in an open position, since the portions of the side walls 28 and 30 together with the corresponding portions of end shells 12 and 14 extend upwardly from the pivot line of the lid flaps 32 and 34, forming the ledge 80. Each of the lid flaps is provided with suitable associated latch means 94 so that the case may be conveniently secured in a closed position when it is being carried or stored.

To increase the usefulness of the article, a plurality of partitions are preferably provided which divide the interior into discrete compartments. The partitions are preferably maintained in position by disposing their opposite end in the channels 20 and 22 so that they may be secured by the plural series of rivet assemblies 40 and 42.

Reference is made to Platt, Pat. No. 3,259,217, which is incorporated herein as though reproduced in its entirety. The plural series of rivet assemblies 40 and 42 in conjunction with the guards 36 and 38 replace some of the more vulnerable stitching of the Platt case, while providing enhanced strength, rigidity, durability, and damage resistance. Furthermore, the silver colored guards present a striking and attractive contrasting border for the carrying case.

Thus, a carrying case, maintaining the positive qualities of the Platt case is presented with improved structural strength, durability, and load-bearing characteristics.

Various changes and modifications may be made in the above-described article without deviating from the spirit and scope of the present invention.

Various features of the present invention are set forth in the following claims.

What is claimed is:

1. A carrying case adaptable for carrying relatively heavy objects comprising:

a unitary member of U-shaped cross section constituted by side walls and a bottom wall including a reinforcing plate;

molded end shells of relatively rigid material, each having a flat panel in the shape of a rectangle with arcuate corners, each end shell having a peripheral flange extending along the periphery of the flat panel, the flange including a lesser periphery extending outwardly and substantially perpendicular to the flat panel, a curved portion where the flange reverses back upon itself, and a greater periphery spaced apart from and substantially parallel to the lesser periphery, the lesser periphery and the curved portion and the greater periphery successively constituting the flange and defining an inwardly facing channel for receiving an edge of said unitary member;

overlying and underlying lid flaps each hinged below the tops of said end shells and conforming to the upper portions and respective arcuate corners of the peripheral flanges of said end shells when the case is in a closed position, said overlying flap having an aperture so as to receive therethrough a handle secured to said underlying flap so that the carrying case may conveniently be carried when in a closed position;

U-shaped metal guards, each guard having a longer arm and a shorter arm so that the guard has an L-shaped cross section, said longer arm extending generally parallel to and adjacent the respective greater periphery, said shorter arm extending adjacent the respective curved portion but unattached thereto; and rivet assemblies arranged in a single respective series along each of said guards, each of said rivet assemblies extending through sequentially the longer arm of the respective guard, the greater periphery of the respective flange, an edge of the unitary member, and the lesser periphery of the respective flange.

* * * * *

UNITED STATES PATENT AND TRADEMARK OFFICE

CERTIFICATE OF CORRECTION

PATENT NO. : 4,374,555

DATED : February 22, 1983

INVENTOR(S) : Joseph Eugene March

It is certified that error appears in the above-identified patent and that said Letters Patent is hereby corrected as shown below:

Column 2, line 58, before "28" insert a space.

Column 3, line 34, change "a" to --the--;

line 44, change "an" to --the--.

Column 5, line 16, change "34" to --32--;

line 20, change "90" to --86--;

line 51, after "case" insert a comma.

Signed and Sealed this

Seventh Day of June 1983

[SEAL]

*Attest:*

DONALD J. QUIGG

*Attesting Officer*

*Acting Commissioner of Patents and Trademarks*